United States Patent [19]

Shirai et al.

[11] Patent Number: 4,847,968

[45] Date of Patent: Jul. 18, 1989

[54] FORGING METHOD FOR PRODUCING A PULLEY

[75] Inventors: Tokuo Shirai, Aichi; Kazuhiro Morita, Anjo, both of Japan

[73] Assignee: Nippondenso Co., Ltd., Kariya, Japan

[21] Appl. No.: 259,441

[22] Filed: Oct. 17, 1988

Related U.S. Application Data

[63] Continuation of Ser. No. 917,508, Oct. 10, 1986, abandoned.

[30] Foreign Application Priority Data

Oct. 16, 1985 [JP] Japan ..... 60-230661
Jun. 26, 1986 [JP] Japan ..... 61-150056

[51] Int. Cl.[4] ..... B21K 1/42; B21D 53/26

[52] U.S. Cl. ..... 29/159 R; 72/353; 72/356; 72/358; 72/359

[58] Field of Search ..... 72/264, 267, 352–354, 72/356, 358, 359, 340, 68, 345; 29/159 R

[56] References Cited

U.S. PATENT DOCUMENTS

| | | | |
|---|---|---|---|
| 2,253,611 | 8/1941 | Davis | 72/359 |
| 2,328,098 | 8/1943 | Remington et al. | 72/267 |
| 3,120,769 | 2/1964 | Hatebur | 72/354 |
| 3,835,686 | 9/1974 | Lawson et al. | 72/358 |
| 4,290,295 | 9/1981 | Kanamaru et al. | 29/159 R |
| 4,580,431 | 4/1986 | Oku et al. | 72/359 |
| 4,590,782 | 5/1986 | Leykamm | 72/359 |
| 4,697,445 | 10/1987 | Tanaka et al. | 29/159 R |

FOREIGN PATENT DOCUMENTS

| | | | |
|---|---|---|---|
| 412858 | 4/1925 | Fed. Rep. of Germany . | |
| 2747382 | 4/1978 | Fed. Rep. of Germany . | |
| 2934155 | 2/1980 | Fed. Rep. of Germany . | |
| 1189352 | 10/1959 | France | 72/360 |
| 1339449 | 8/1963 | France | 72/345 |
| 97838 | 7/1980 | Japan | 72/356 |
| 58-49876 | 11/1980 | Japan . | |
| 58-49155 | 11/1983 | Japan | 72/267 |
| 703210 | 12/1979 | U.S.S.R. | 72/272 |
| 836706 | 6/1960 | United Kingdom | 72/358 |
| 1564577 | 10/1980 | United Kingdom . | |

*Primary Examiner*—Robert L. Spruill
*Attorney, Agent, or Firm*—Cushman, Darby & Cushman

[57] ABSTRACT

During the forging step two metallic flows are generated in the metallic blank, one is an elongating flow toward the flange portion and another is an elongating flow toward the cylindrical portion. These metallic flow are generated simultaneously.

Since the metallic blank elongates toward the cylindrical portion and the flange portion at the same time, the metallic structure of the product formed by the present forging method does not develop a slide surface, so that no weak portion is generated in the product.

1 Claim, 7 Drawing Sheets

FORGING METHOD FOR PRODUCING A PULLEY

This is a continuation of application Ser. No. 06/917,508, filed Oct. 10, 1986, now abandoned.

BACKGROUND OF THE INVENTION

1. Field of the Invention

The present invention relates to method for forging a metallic blank in order to form a cup-shaped product having a flange at an outer surface thereof. The product made by the present forging method is useful for use as a pulley, for example.

2. Description of the Prior Art

Conventionally, a cup-shaped product having a flange at an outer surface thereof is formed by forging from a metallic blank. However, according to the conventional forging method, the flange portion must be forged as a different step from that of the cup portion. As described in Japanese patent publication No. 55-49876, a cup portion is forged first, then a flange portion is formed by another forging step.

Such conventional steps are described with reference to FIGS. 13–15.

The metallic blank 100 having such shape as shown in FIG. 13 is forged in order to be a cup-shaped metallic member as shown in FIG. 14. Then a thick portion 105 of the metallic member 104 shown in FIG. 14 is forged again in order to be the shape shown in FIG. 15.

As described above, the conventional forging method has to employ a plurality of forging steps, so that the conventional method has a problem of expending much cost and much working time.

SUMMARY OF THE INVENTION

The present invention has an object for forming a cup-shaped product having a flange at an outer surface thereof by single forging step.

In order to attain the object, the present inventors tried to form the flange 101 and the cylindrical portion 102 by squeezing the metallic blank 100 as shown in FIG. 16.

THe product made by the method shown in FIG. 16, however, has a defect. Namely, the product has a crack at the flange portion 101. After carefully studying the crack, the present inventors concluded how the crack occurred as follows. In order to carry out the squeezing forging method, the metallic blank 100 is located inside of the side die portion 200 which has an inner diameter which is almost same as an outer diameter of the metallic blank 100, as shown in FIG. 17. One end of the metallic blank 100 faces a first punch 201 having an outer diameter which is smaller than that of the metallic blank 100 and the other end of the metallic blank 100 faces a second punch 202 having an outer diameter which is almost same as that of metallic blank 100.

The second punch 202 is then moved toward the first punch 201. Since a side surface of the metallic blank 100 is contacted with the inner surface of the side die portion 200, the metallic blank 100 elongates toward the outside of the first punch 201. It should be noted that a plate portion of the metallic blank which becomes the flange portion 101 is not deformed during the operation, so that the metallic structure in this portion 101 should remain the same. On the other hand, the metallic structure of the metallic blank elongating toward the outside of the first punch is deformed greatly for forming the cylindrical portion 102.

Therefore, a slide surface 300 occurs at the boundary between the metallic structure of the flange portion 101 and that of cylindrical portion 102.

The metallic strength must weaken at this slide surface 300, so that the product has a tendency to occur crack at this slide surface 300.

If the thickness of the flange portion 101 is large enough, the slide surface 300, even if it occurs, does not have much influence for reducing the strength. In other words, if the thickness of the flange portion 101 is large enough, no crack appears at the slide surface 300.

Accordingly the forging method shown in FIGS. 16–18 can be used for a product having a thick flange portion. However, such forging method can not be used a the product having a thin flange portion, such as a pulley.

The present inventors have created forging methods which can be used for a product having a thin flange portion without the occurrence of a crack at the flange portion.

In order to attain the object described above, the forging method of the present invention deforms the metallic blank for elongation in two directions, one elongation makes the flange portion and the other elongation makes the cylindrical portion. In other words, the forging method of the present invention does not make the flange portion and the cylindrical portion by reducing the outer diameter of the metallic blank.

During the forging step of the present invention two metallic flows are generated in the metallic blank, one is an elongating flow toward the flange portion and the other is an elongating flow toward the cylindrical portion. These metallic flow are generated simultaneously.

Since the metallic blank elongates toward the cylindrical portion and the flange portion at the same time, the metallic structure of the product formed by the present forging method does not develop the slide surface, so that no weak portion is generated in the product.

DESCRIPTION OF THE PREFERRED EMBODIMENTS

Figure 1:
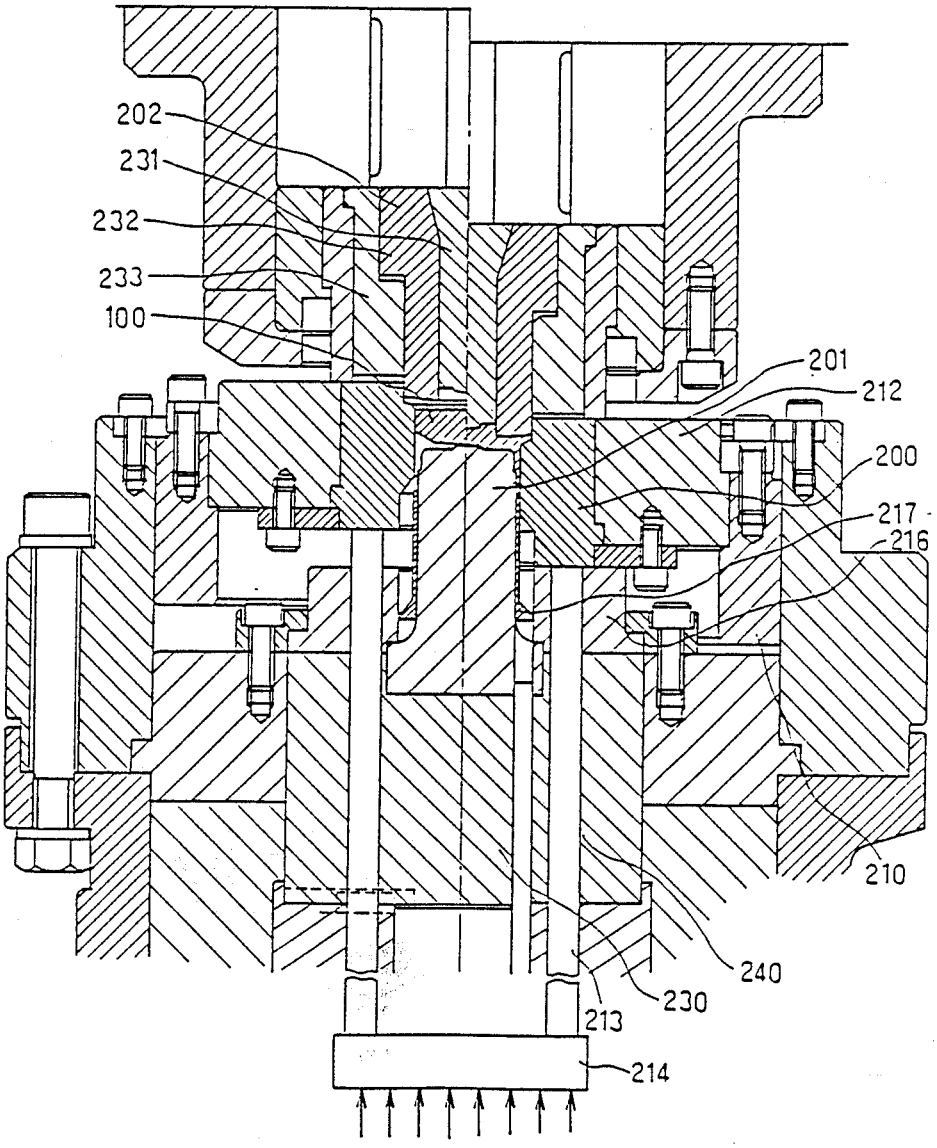
FIG. 1 is a sectional view showing a forging apparatus, embodying this invention.

A preferred embodiment of the present invention is explained hereinafter. FIG. 1 shows an apparatus for the present forging method. Numeral 201 indicates a first punch made of high speed steel (SKH 51), and this first punch 201 is fixed on a holding base 230. Numeral 202 indicates a second punch facing the first punch 201. This second punch 202 has an inner die portion 231 and an outer die portion 232, both made of high speed steel (SKH 51). A punch reinforcing ring 233 embraces an outer surface of the outer die portion 232, and fixes the inner and the outer die portions together.

Figure 2:
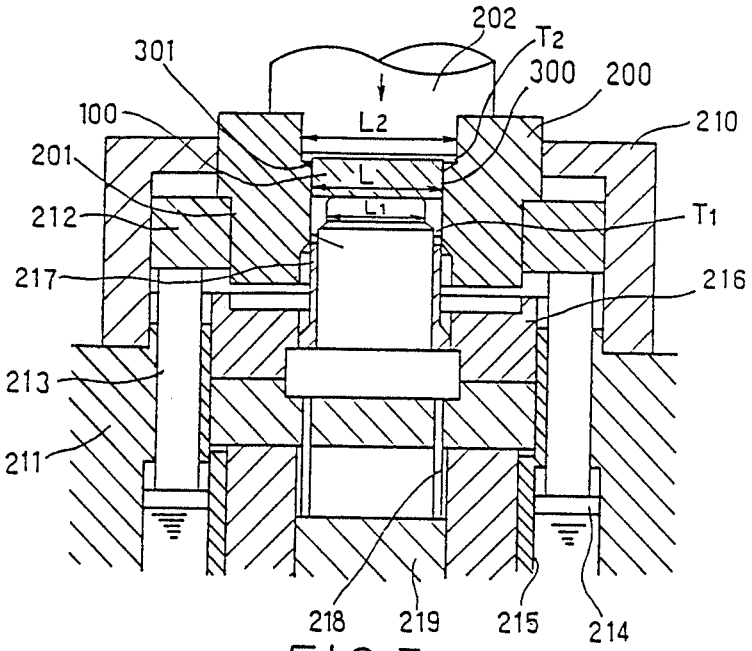
FIGS. 2 and 3 are sectional views showing the operation of the forging apparatus shown in FIG. 1.

A side die portion 200 is located between the first punch 201 and the second punch 202 in such a manner that the side die portion 200 embraces the metallic blank 100. The side die portion 200 is made of tool steel (SKD 11), is embraced by a reinforcing ring 212, and supported by the vertically movable supporting bars 213. The supporting bars 213 extend through holes 240 in a holding base, and their lower ends are connected with a piston 214 of a hydraulic cylinder 215 (FIG. 2). The supporting bars 213 and the side die portion 200 force the first punch 201 upward in order to keep the form of the flange portion formed between the side die portion 200 and the outer die portion of the second punch 202 uniformly.

As shown in FIG. 2, an outer diameter L1 of the first punch 201 is smaller than that L of the metallic blank 100, and an outer diameter L2 of the end portion of the second punch 202 which faces the metallic blank 100 is larger than that L of the metallic blank 100. The inner diameter of an inner surface of the side die portion 200 which faces the metallic blank is almost the same as the outer diameter L of the metallic blank 100.

The inner diameter of the inner surface which the second punch 202 contacts is almost the same as the outer diameter L2 of the second punch 202. Namely an annular groove 301 is formed at the inner surface of the die facing the second punch 202, and the inner diameter of the deepest portion of the annular groove 301 is almost the same as the outer diameter L2 of the second punch 202.

Therefore, a cylindrical die chamber T1 is formed between the first punch 201 and the side die portion 200, and a flange die portion chamber T2 is formed between the annular groove 301 of the side die portion 200 and the second punch 202.

The method using the apparatus described above is explained hereinafter.

At the time when the second punch 202 is moved upward, the metallic blank 100 is set on the first punch 201 by apparatus which is not described. The metallic blank 100 is so set on the first punch 201 that the metallic blank 100 fits in the inner surface 300 of the side die portion 200 as shown in FIG. 4 and the upper portion of the metallic blank 100 faces the annular groove 301 of the side die portion 200.

Then the second punch 202 is forced to move downward with a high forcing power, e.g. about 600-1000 t. When the second punch 202 is moved downward, it is inserted into the annular groove 301 of the side die portion 200 (shown in FIG. 2). The second punch 202 is further moved downward until the side die portion 200 contact with the receiving base 216 (shown in FIG. 2). Namely, the side die portion 200 is also moved downwardly with the movement of the second punch 202. The side die portion 200, on the other hand, is forced upward by the oil pressure in the cylinder 215. The side die portion 200 receives the forcing power from the piston through the supporting bars 213 so as to be always in contact with the second punch 202 and prevent the occurrence of a gap between the second punch 202 and the side die portion 200 and the elongation of the metallic blank toward such gap.

Figure 4:
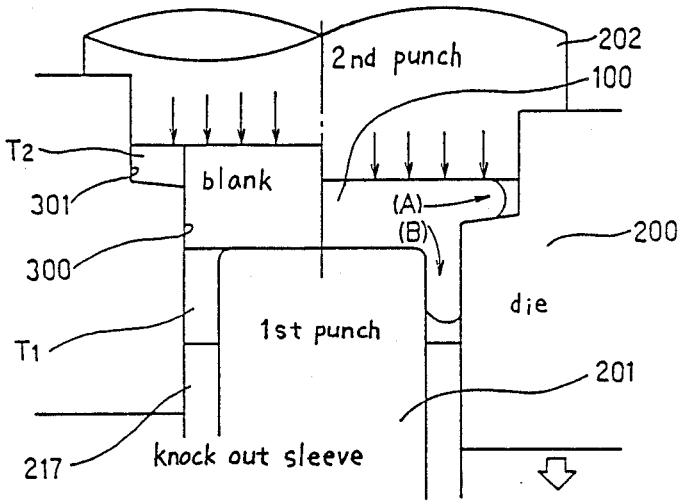
FIG. 4 is a sectional view explaining the forging method of the present invention.

During the movement of the second punch 202, there are two metallic flows in the metallic blank 100, one is the flow A elongating toward the annular groove 301 and the other is flow B elongating toward the cylindrical die portion T1 as shown in FIG. 4. As clearly shown from FIG. 4, the resistance against the flow A toward the flange shaped die portion T2 is almost as same as that against the flow B toward the cylindrical portion T1. Therefore, the metallic flow in the metallic blank 100 is shared evenly between the flow A toward the flange die portion T1 and the flow B toward the cylindrical die portion T2.

Accordingly, the forging method of the present invention can well prevent the situation where the metallic flow in only one direction T1 (T2) and the other flow in the other direction T2 (T1) starts after the one flow (T2) is terminated, i.e. where the two flows are successive.

If one die portion T1 (T2) has a much larger volume than the other one T2 (T1), the metallic blank has a tendency to elongate toward such larger volume, and the metallic flow toward the other die chamber having a smaller volume starts after the metallic flow toward the larger chamber terminates. Furthermore when metallic flow toward the smaller die chamber occurs, reverse flow from the larger die chamber to the smaller die chamber occurs. This reverse flow makes a slide surface at the boundary between the metallic structure in the larger die chamber and the metallic structure in the smaller die chamber. This slide surface makes the metallic structure weak and causes structural damage, such as a crack.

Such damage described above may not be incurred by the present forging method, because the sectional area of the flange shaped die chamber T2 is almost same as that of the cylindrical die chamber T1.

It should be noted that the starting timing of the metallic flows toward both die chambers T1 and T2 do not have to be the same. The metallic flow toward one die chamber T1 (T2) can start after the metallic flow toward the die chamber T2 (T1) starts. The important point the forging method is the termination timing, namely both metallic flows toward the die chambers T1 and T2 should terminate at the same time.

If the metallic flow elongating toward one die chamber T1 (T2) continues after the metallic flow toward the other die chamber T2 (T1) is terminated, such continuing metallic flow makes a slide surface and causes the metallic structure to weaken.

It is preferred that a knock out sleeve 217 is positioned between the first punch 201 and the side die portion 200 during the whole movement of the second punch 202 and the side die portion 200 downward.

Figure 5:
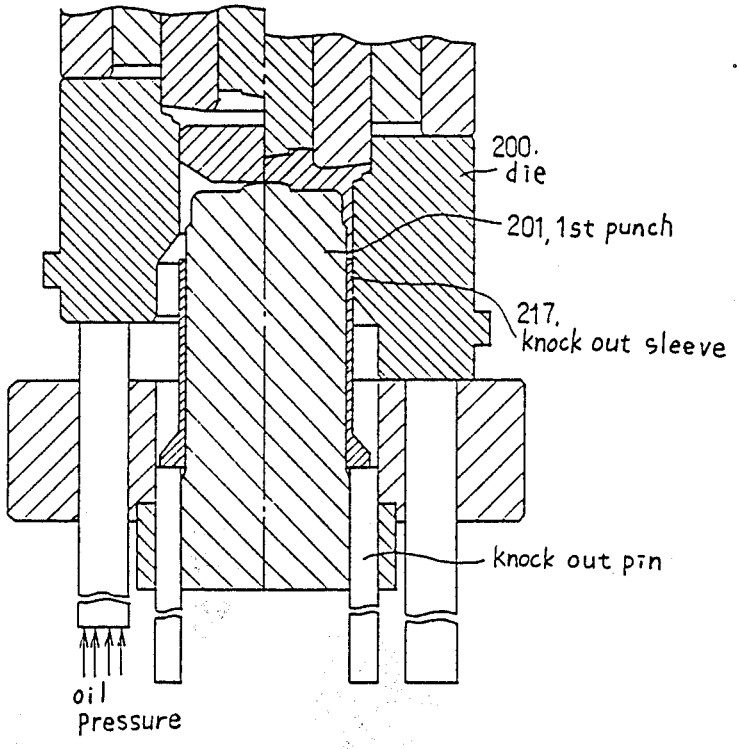
FIG. 5 is a sectional view showing a knock out sleeve according to the forging apparatus of the present invention.

FIG. 5 shows a forging apparatus having a knock out sleeve 217 which is not positioned between the side die portion 200 and the first punch 201 when the forging starts and is located between the side die portion 200 and the first punch 201 when the second punch 202 and the side die portion 200 moves downwardly.

Figure 6:
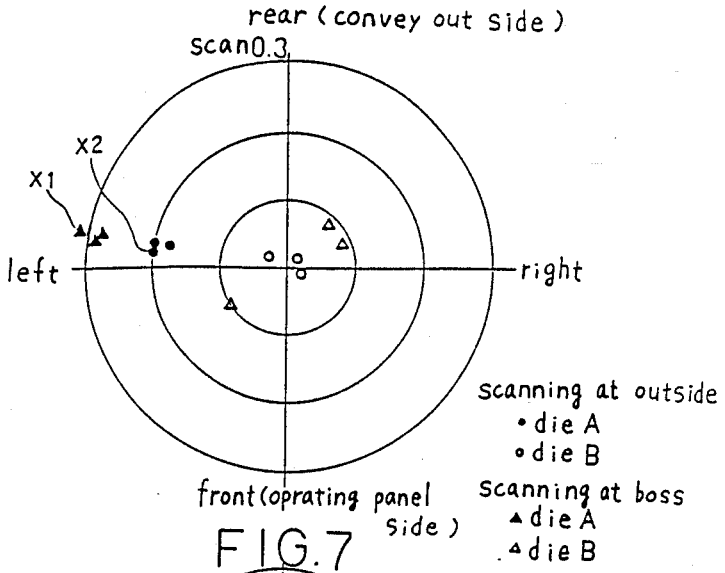
FIG. 6 is a graph explaining scattering of the thickness of the products produced by the apparatus shown in FIG. 5 and another apparatus shown in FIG. 8.
Figure 9:
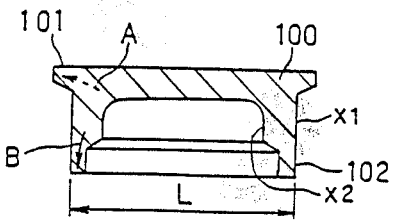
FIG. 9 is a sectional view showing a product produced by the forging method of the present invention.

However, the products made by the forging apparatus shown in FIG. 5 have a defect in that the thickness of the product can not be made uniform as shown by the dots X1 and X2 in FIG. 6. The dot X1 indicates the scattering or variation of the thickness of the product at a portion X1 shown in FIG. 9, and the dot X2 indicates the scattering of the thickness of the product at x2 shown in FIG. 9.

Figure 7:
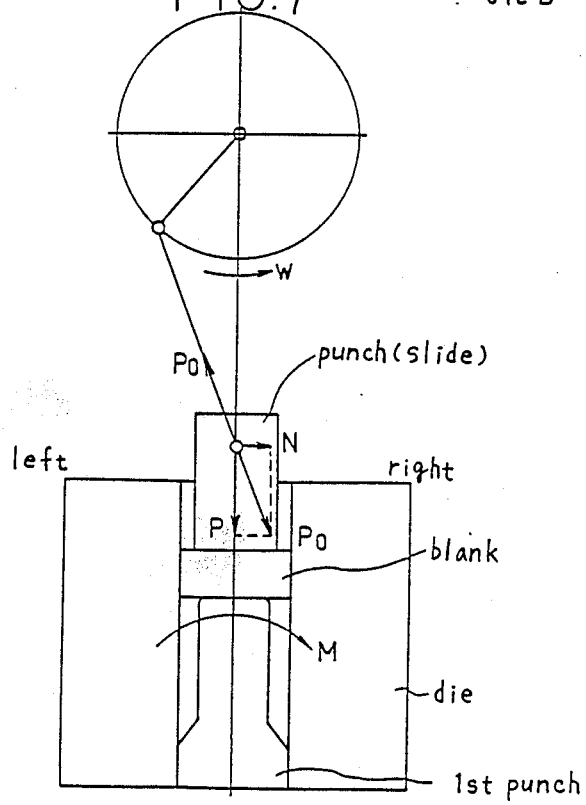
FIG. 7 is a schematic view explaining the moving power of the apparatus shown in FIG. 5.

The present inventors had studied about the scattering and decided that such scattering is caused by the moment M shown in FIG. 7. The moment M generated when the second punch 202 moves downward makes the metallic blank 100 and the first punch 201 slide horizontally, and makes the thickness of the product lack uniformity.

Figure 8:
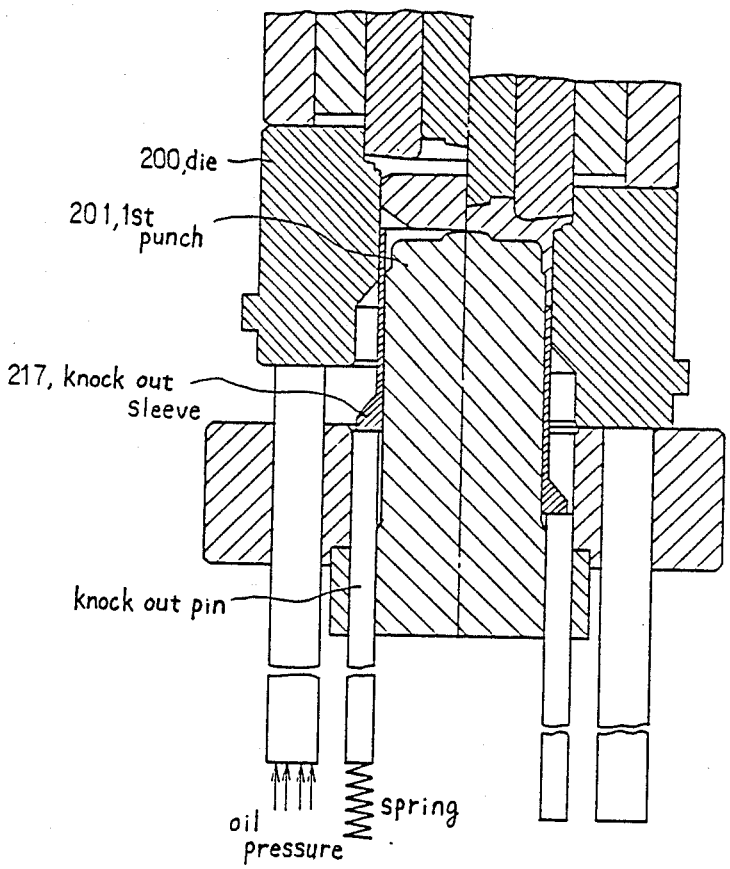
FIG. 8 is a sectional view showing a forging apparatus an employing an improved knock out sleeve.

Therefore, the forging apparatus of the present invention employs the knock out sleeve 217 inserted between the first punch 201 and the side die portion 200 from the starting timing when the second punch 202 and the side die portion 200 moves downward as shown in FIG. 8 to the terminating timing. The location of the knock out sleeve 217 between the first punch 201 and the side die portion 200 prevents horizontal sliding of the first punch 201. The knock out sleeve 217 is forced to move downward by deformation of the metallic blank 100.

Figure 3:
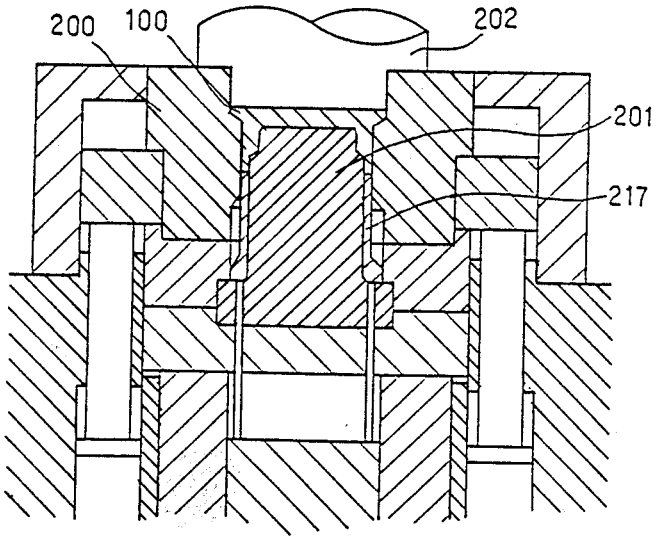

After the second punch 202 is moved down to the predetermined position shown in FIG. 3, the second punch 202 is pulled up by pulling apparatus which is not shown. When the second punch 202 is pulled up, the product 100 remains between the first punch 201 and the side die portion 200. Then, the product 100 is pushed up from the die portion between the first punch 201 and the side die portion 200 by the knock out sleeve 217. After that, the product 100 is taken from the forging apparatus to the next machining step.

Figure 10:
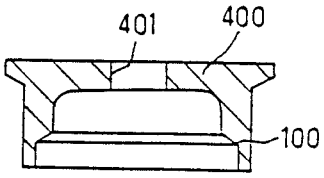
FIGS. 10, 11 and 12 are sectional views showing machining steps of the product.
Figure 11:
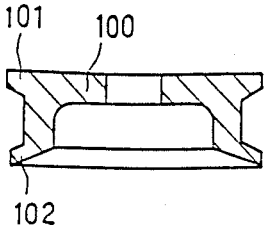
Figure 12:
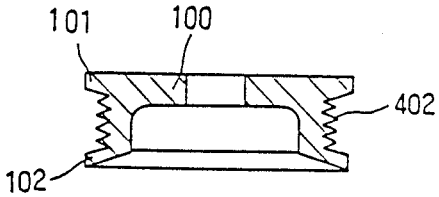
Figure 13:
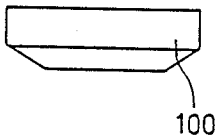
FIGS. 13, 14 and 15 are sectional views explaining conventional forging methods.
Figure 14:
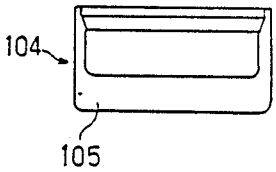
Figure 15:
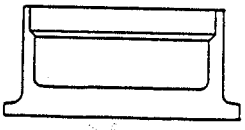
Figure 16:
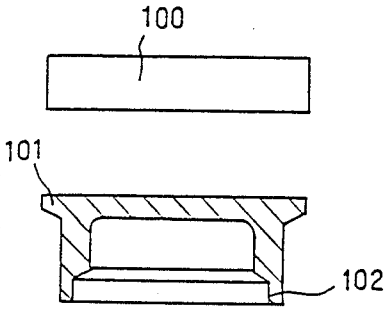
FIG. 16 is a sectional view explaining a forging method the present inventors have performed on the way to invent the present invention.
Figure 17:
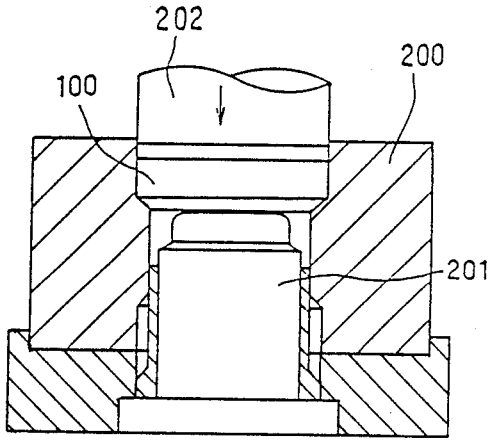
FIGS. 17 and 18 are sectional views showing forging apparatus used for the forging method shown in FIG. 16.
Figure 18:
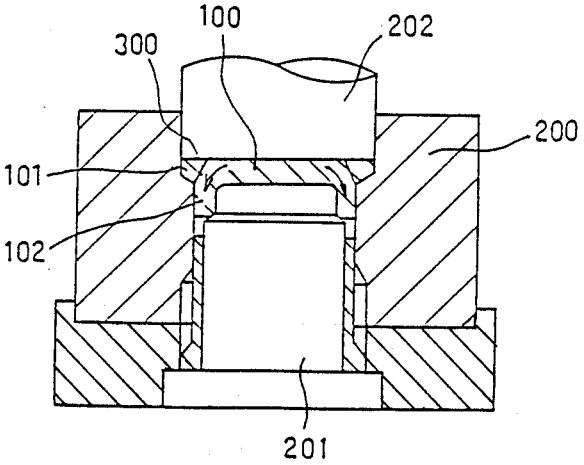

The product 100 is annealed; then a pulley hole 401 is stamped at the bottom portion 400 of the product 100 as shown in FIG. 10. After that, the cylindrical portion 102 of the product 100 is forged outwardly as shown in FIG. 11 in order to make the flange 102 at the outer side surface of the product 100. The product having the flanges 101 and 102 then is machined for forming a plurality of grooves 402 at the outer side surface as shown in FIG. 12.

As described above, the forging method of the present invention can form a cup-shaped product having a flange by elongating the metallic blank toward both the flange portion and the cylindrical portion. Furthermore, the metallic flow in one direction starts at least before the terminating timing of the metallic flow in the other direction. So that, according to the forging method of the present invention, a slide surface can not be formed in both the flange portion and the cylindrical portion of the product, and the occurrence of a metallic structural defect, such as a crack, is well prevented.

The forging apparatus of the present invention can attain these forging methods effectively.

What is claimed is:

1. Method for producing a pulley having flanges at both ends thereof and a plurality of circumferential grooves between said flanges, the steps comprising:

locating a metallic disc-like blank having an outer diameter smaller than the maximum outer diameter of the pulley on the working end of a first circular punch having an outer diameter smaller than that of the blank;

locating the working end of a second circular punch having an outer diameter greater than that of said blank in opposition to the working end of said first punch with the blank therebetween to be compressed thereby;

locating about the punches and the blank a side die portion provided with an inner cylindrical surface having a diameter substantially the same as the outer diameter of the blank and an annular groove at one end of the cylindrical surface adjacent said second punch, said side die portion being so located and arranged that a cylindrical die chamber is formed between an outer peripheral surface of said first punch and the inner cylindrical surface of said die portion and a flange shaped die chamber is formed between said second punch and said groove;

reducing the distance between said punch ends by moving said second punch and said side die portion while maintaining the shape of said flange shaped die chamber in order to flow the metal of the blank toward said cylindrical die chamber in such a manner that a direction of the metal flow coincides with a direction of the movement of said side die portion and in order to elongate the metal of the blank toward said flange shaped die chamber for forming one of the pulley flanges, the elongations toward said die chambers being carried out so that the elongation toward one of said chambers starts before the elongation toward the other chamber finishes and the elongations toward both chambers finish at substantially the same time;

forging the metal elongated into said cylindrical die chamber outward for forming the other pulley flange; and machining the blank between said flanges to form a plurality of circumferential grooves.

* * * * *